US010406655B2

(12) United States Patent
Wang

(10) Patent No.: US 10,406,655 B2
(45) Date of Patent: Sep. 10, 2019

(54) ADJUSTABLE PLIER

(71) Applicants: HANGZHOU GREAT STAR INDUSTRIAL CO., LTD., Hangzhou (CN); HANGZHOU GREAT STAR TOOLS CO., LTD., Hangzhou (CN)

(72) Inventor: Min Wang, Hangzhou (CN)

(73) Assignees: HANGZHOU GREAT STAR TOOLS CO., LTD, Zhejiang (CN); HANGZHOU GREAT STAR INDUSTRIAL CO., LTD., Zhejiang (CN)

( * ) Notice: Subject to any disclaimer, the term of this patent is extended or adjusted under 35 U.S.C. 154(b) by 232 days.

(21) Appl. No.: 15/443,348

(22) Filed: Feb. 27, 2017

(65) Prior Publication Data

US 2017/0361427 A1 Dec. 21, 2017

Related U.S. Application Data

(63) Continuation-in-part of application No. PCT/CN2017/073666, filed on Feb. 15, 2017, and a (Continued)

(51) Int. Cl.
*B25B 7/10* (2006.01)

(52) U.S. Cl.
CPC ..... *B25B 7/10* (2013.01)

(58) Field of Classification Search
CPC ..... B25B 7/04; B25B 7/10
See application file for complete search history.

(56) References Cited

U.S. PATENT DOCUMENTS 4,048,878 A 9/1977 Nystrom
4,269,089 A 5/1981 Hastings (Continued)

FOREIGN PATENT DOCUMENTS

CN 101190513 A 6/2008
CN 201455835 U 5/2010

(Continued)

*Primary Examiner* — David B. Thomas
(74) *Attorney, Agent, or Firm* — Cantor Colburn LLP

(57) ABSTRACT

The present invention discloses a pair of adjustable pliers, comprising a first handle and a second handle, both of which have a gripping part arranged at a front end thereof, the two gripping parts forming a jaw span, the first handle and the second handle being arranged in an intersectional manner and relatively fixed via a connecting mechanism, wherein the second handle has an elongated rack slot at a position of the connecting mechanism, and the rack slot is provided with a toothed rack on an inner side part thereof. The connecting mechanism comprises a positioning snap piece arranged inside the rack slot and a link mechanism connected with the positioning snap piece, the positioning snap piece has lateral teeth which are engaged with the toothed rack on the rack slot, the link mechanism is provided to drive the positioning snap piece to rotate and disengage the lateral teeth on the positioning snap piece from the toothed rack. Thus the first handle can move relative to the second handle along the rack slot through the movement of the connecting mechanism. The link mechanism comprises a trigger shaft connected with the positioning snap piece, and the trigger shaft has a trigger part thereon. The present invention has the advantages that the right handle can be directly pushed to achieve the quick one-way adjustment, which is convenient and saves effort compared to the ordinary water pump pliers that need two-handed adjustment.

17 Claims, 15 Drawing Sheets

Related U.S. Application Data continuation-in-part of application No. 14/369,775, filed on Jun. 30, 2014, now Pat. No. 9,592,589.

(56) References Cited

U.S. PATENT DOCUMENTS

| | | | | |
|---|---|---|---|---|
| 4,438,669 | A | 3/1984 | Hastings | |
| 5,351,584 | A | 10/1994 | Warheit | |
| 5,461,951 | A | 10/1995 | Putsch | |
| 5,845,551 | A | 12/1998 | Putsch | |
| 5,887,495 | A | 3/1999 | Kao | |
| 6,199,459 | B1 | 3/2001 | Azkona | |
| 6,502,482 | B1 | 1/2003 | Putsch | |
| 7,255,027 | B1 | 8/2007 | Tsai | |
| 7,406,898 | B1 | 8/2008 | Hall | |
| 8,661,948 | B2 * | 3/2014 | DeBaker | B21K 5/00 81/405 |
| 8,695,464 | B2 * | 4/2014 | Herrmann | B25B 7/10 81/409 |
| 9,687,965 | B2 * | 6/2017 | DeBaker | B21K 5/00 |
| 2002/0139227 | A1 | 10/2002 | Azkona | |
| 2004/0221694 | A1 | 11/2004 | Kuo | |
| 2010/0282032 | A1 * | 11/2010 | Brailey | B25B 7/10 81/385 |
| 2012/0111157 | A1 | 5/2012 | Qiu | |

FOREIGN PATENT DOCUMENTS

| | | | |
|---|---|---|---|
| CN | 203077167 | U | 7/2013 |
| CN | 203779360 | U | 8/2014 |
| CN | 104476427 | A | 4/2015 |
| CN | 104690660 | A | 6/2015 |
| CN | 106002791 | A | 10/2016 |
| EP | 2149427 | A1 | 2/2010 |
| GB | 1265295 | | 3/1972 |
| JP | 3073927 | A | 12/2000 |

* cited by examiner

ADJUSTABLE PLIER

This application is a continuation-in-part of U.S. patent application Ser. No. 14/369,775, which was filed on Jun. 30, 2014 under 35 U.S.C. 371 as the U.S. national stage of International Patent Application No. PCT/CN2013/088780, which was filed on Dec. 6, 2013 claiming priority to Chinese Patent Application Number 201320047726.1 filed on Jan. 25, 2013. This application is also a continuation-in-part of International Patent Application Number PCT/CN2017/073666 filed on Feb. 15, 2017. All of said applications are herein incorporated by reference in their entirety.

FIELD OF THE INVENTION

The present invention relates to a pair of pliers, and more precisely to pliers with a jaw opening which can be adjusted quickly.

DESCRIPTION OF THE PRIOR ART

Traditional pliers have two intersecting plier arms which are rotatable around a pivot in an intersection region for gripping objects. Jaws for gripping objects are formed above the intersection region and handles for holding are below the intersection region. However, the jaw opening of the pliers is fixed, so the size range of the gripped objects is limited.

Therefore, U.S. Pat. No. 5,845,551 discloses a pair of pliers with an adjustable jaw opening, wherein one plier arm is formed with a hollow elongated rack slot in the middle of the intersection region and the rack slot is profiled on its inner flanks, the profiling being a saw-tooth profiling. The other plier arm is displaceable stepwise along the teeth on the inner flanks of the rack slot, and can be fixed to each tooth; thus the span between the jaws can be adjusted.

However, the adjustment of the pliers is both-way, which is to say that the pivot in the intersection region has an adjusting switch. When the switch is on, the two plier arms can move relatively. When the switch is off, the positions of the two plier arms are fixed relatively to be available for use. The drawback of this design is inconvenience in use. In use, firstly turn on the switch, and keep it on, then enlarge the span between the jaws to being larger than the size of the gripped object, and then gradually narrow the span to the exact size of the object to grip it only if the switch is kept on. Both processes of enlarging and narrowing the span require keeping the switch on to adjust the span between the jaws. Therefore, it is very inconvenient for users, so further improvement is needed in order that not only holding the switch all the time is no more required, but also the design of the switch is more simple and convenient.

SUMMARY OF THE INVENTION

The objective of the present invention is to provide a pair of pliers, wherein only one-way adjustment of the jaw opening needs an adjusting switch while the adjustment of the jaw opening in the other way does not need any switch, thus stabilizing the plier jaws on the object to be gripped.

Another objective of the present invention is to provide a pair of pliers with an adjustable jaw opening, wherein the adjusting switch is designed simple and convenient to use.

A pair of adjustable pliers comprises a first handle having a first gripping part arranged at a front end thereof and a second handle having a second gripping part arranged at a front end thereof, the first gripping part and the second gripping part forming a jaw span, the first handle and the second handle being arranged in an intersectional manner and relatively fixed via a connecting mechanism, wherein the second handle has an elongated rack slot at a position of the connecting mechanism, and the rack slot is provided with a toothed rack on an inner side part thereof. The connecting mechanism comprises a positioning snap piece arranged inside the rack slot and a link mechanism connected with the positioning snap piece, the positioning snap piece has lateral teeth which are engaged with the toothed rack on the rack slot, and the link mechanism is provided to drive the positioning snap piece to rotate and disengage the lateral teeth on the positioning snap piece from the toothed rack. Thus the first handle can move relative to the second handle along the rack slot through the movement of the connecting mechanism. The link mechanism comprises a trigger shaft connected with the positioning snap piece, and the trigger shaft has a trigger part thereon.

Further, teeth of the toothed rack are one-way ratchet teeth.

Further, the trigger shaft is arranged in a through-hole of the positioning snap piece, and the trigger part is a pressing part of the trigger shaft extending to the outer side of the surface of the first handle.

Further, the link mechanism further comprises a roller pin arranged on the trigger shaft at a position of the positioning snap piece, one end of the roller pin extending out from the lateral of the trigger shaft, the other end thereof extending onto an inclined plane of the positioning snap piece.

Further, the inclined plane is located at an upper side of the through-hole of the positioning snap piece, and the lateral teeth of the positioning snap piece are located at one side of the lower part under the through-hole of the positioning snap piece.

Further, the inclined plane gradually descends from one side of the lateral teeth of the positioning snap piece to the other side thereof.

Further, the roller pin can be fixedly connected or integrated with the trigger shaft.

Further, one end of the roller pin extends into a lateral hole of the trigger shaft, and is fixedly connected with the trigger shaft.

Further, a shape of a cross-section of the trigger shaft is a notched circle.

Further, the link mechanism further comprises a sheet body with a hollow hole, which makes it sheathed on the trigger shaft, and the shape of the hollow hole fits that of the cross-section of the trigger shaft.

Further, a lateral wall of the first handle is provided with a lateral hole at a position of the connecting mechanism, and the lateral hole allows a corresponding region of the second handle to pass through, forming a first part of the first handle located over the second handle and a second part of the first handle located beneath the second handle, wherein the trigger shaft passes through the first part of the first handle, and then passes through the rack slot of the second handle, and further passes through the second part of the first handle.

Further, a first end of the trigger shaft extends to the first part at one side of the first handle, and a second end extends to the second part at the other side of the first handle, wherein the trigger part is located at the outer side of the first part, and is fixed with the trigger shaft via a fixing element at the outer side of the second part.

Further, the positioning snap piece is provided with a fixing part and an elastic piece at the other side, opposite to the lateral teeth, of the lower part under the through-hole, and the elastic piece is connected onto the fixing part and propped against the second handle.

Further, the fixing part is a spring hole, and the elastic piece is a spring which is arranged inside the spring hole.

Further, the planes at the inner side of the first gripping part and the second gripping part are intersected at an angle, a gap is formed between the first gripping part and the second gripping part, and the edges of the inner sides of the first gripping part and the second gripping part are provided with stripes to facilitate gripping and engaging.

Further, the first gripping part or the second gripping part can be integrated with the first handle or the second handle, or can be connected to the handles via connecting means as well.

Further, the sheet body is provided between the positioning snap piece and the fixing element.

Further, the sheet body is located inside the rack slot, and an outer edge of the sheet body is square, fitting an inner edge of the rack slot.

Further, the link mechanism further comprises a pressure spring which is arranged inside a depression of the outer side of the first part of the first handle, contacting the trigger part.

Another shape of jaws is that the first gripping part and the second gripping part are configured as planes, and the edges of the inner sides are provided with stripes. The planes at the inner sides of the first gripping part and the second gripping part are parallel.

The present invention has the advantages that the right handle can be directly pushed to achieve the quick one-way adjustment, which is convenient and saves effort compared to the ordinary water pump pliers that need two-handed adjustment. The button can be integrated with the roller pin, which can save the processing cost and improve the production efficiency.

The novel shape of jaws of the present invention is also brought into better fitness with that of a hexagon nut. Compared to ordinary water pump pliers (which do not fit well with the hexagon nut in larger size), the present product can preferably fit with the hexagon nuts in all sizes within a gear range. The quick one-way gear adjustment is achieved, which is convenient and saves effort compared to the ordinary water pump pliers that need two-handed adjustment. By adoption of the present structure, the engagement between the teeth of the product is more stable, which is more convenient in operation.

DETAILED DESCRIPTION OF THE PREFERRED EMBODIMENTS

Figure 1:
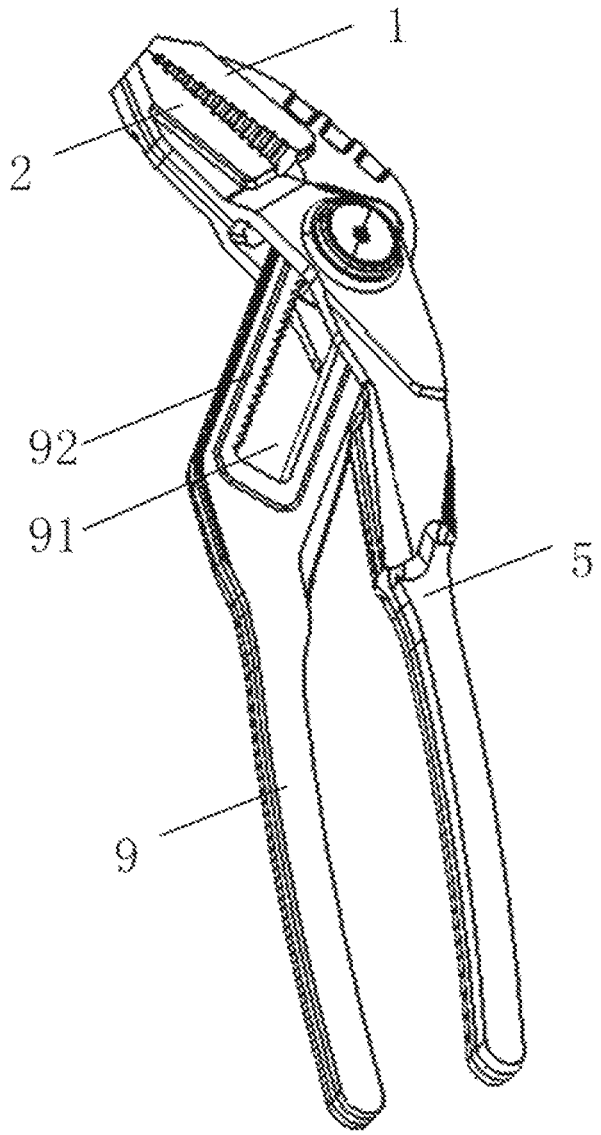
FIG. 1 is a schematic diagram according to a preferable embodiment of the present invention.
Figure 2:
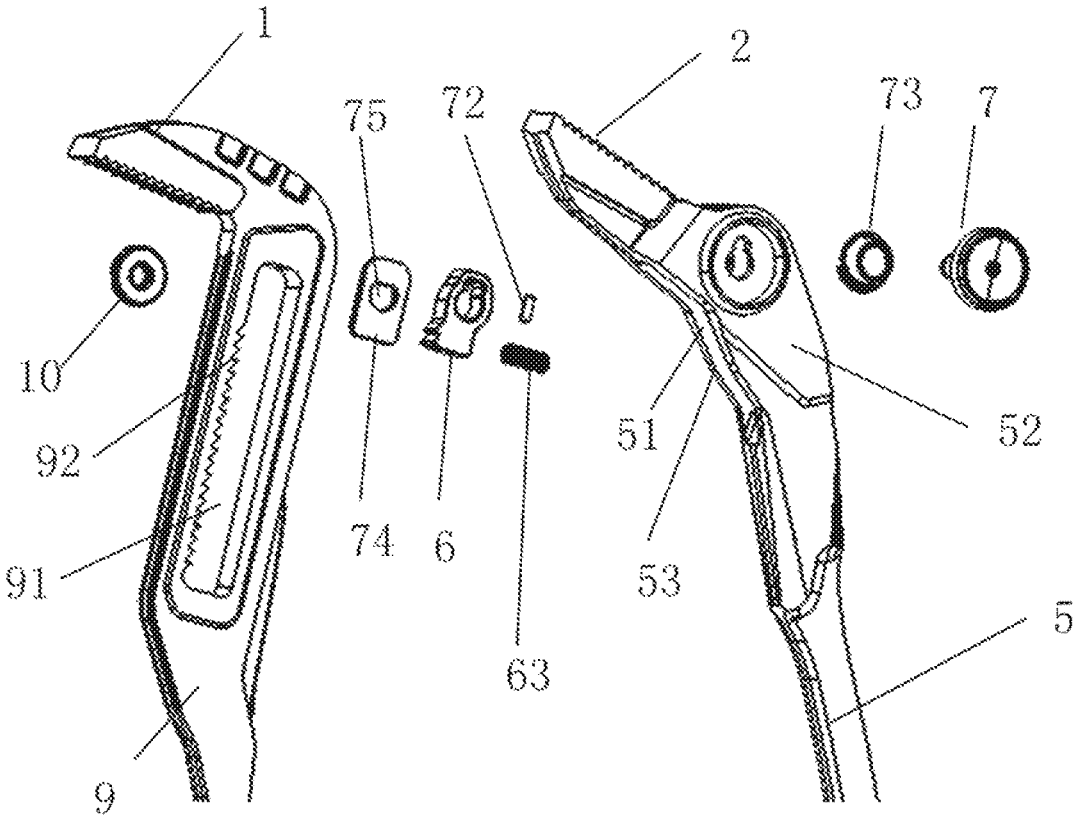
FIG. 2 is an exploded view according to a preferable embodiment of the present invention.
Figure 3:
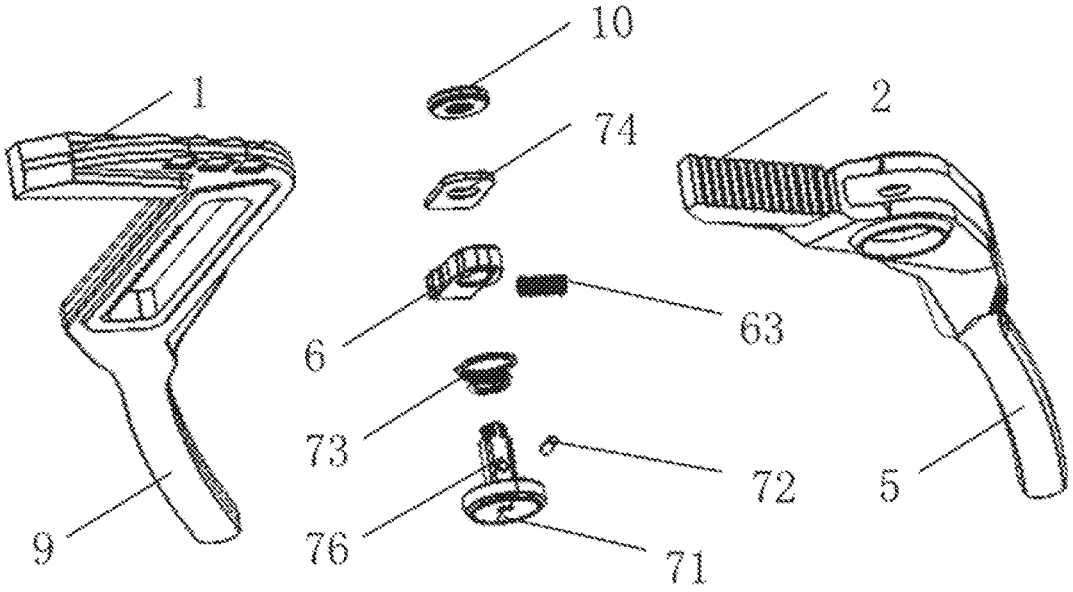
FIG. 3 is an exploded view according to a preferable embodiment of the present invention from another angle.
Figure 4:
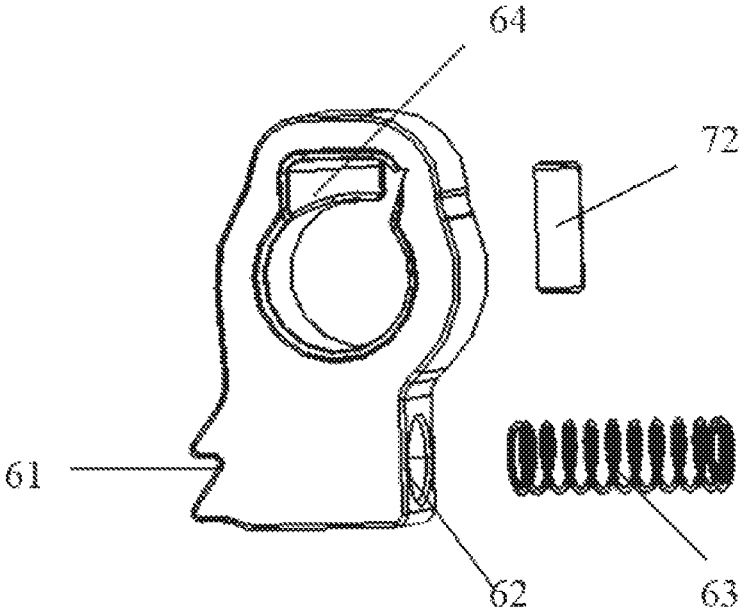
FIG. 4 is an exploded view of the positioning snap piece according to a preferable embodiment of the present invention.
Figure 5:
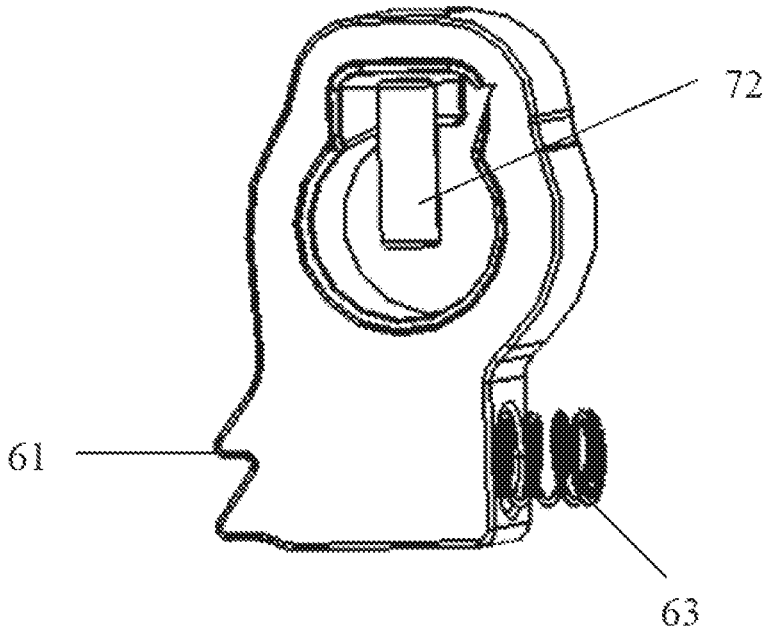
FIG. 5 is a composition diagram of the positioning snap piece according to a preferable embodiment of the present invention.

As shown in FIGS. 1-12, the present invention provides a preferable embodiment. A pair of adjustable pliers comprises a first handle 5 having a first gripping part 2 arranged at the front end thereof and a second handle 9 having a second gripping part 1 arranged at the front end thereof. The first gripping part 2 and the second gripping part 1 form a jaw span, and the first handle and the second handle are arranged in an intersecting manner and relatively fixed via a connecting mechanism, wherein the second handle has an elongated rack slot 91 at the position of the connecting mechanism and the rack slot 91 is provided with a toothed rack 92 on its inner side part. The connecting mechanism comprises a positioning snap piece 6 arranged inside the rack slot 91 and a link mechanism connected with the positioning snap piece 6, the positioning snap piece 6 has lateral teeth 61 which are engaged with the toothed rack 92 profiled on the rack slot 91. The link mechanism drives the positioning snap piece 6 to rotate and disengages from the toothed rack 92. Thus the first handle 5 can move relative to the second handle 9 along the rack slot 91 through the movement of the connecting mechanism to change jaw opening, wherein the teeth on the toothed rack 92 are one-way ratchet teeth, i.e. the teeth are all oblique toward one direction, inclining toward the direction of the arrow as shown in FIG. 1. In this way, when a force is exerted in a direction opposite to the inclining teeth, i.e. the opposite direction of the arrow, due to the barbs between the toothed rack 92 and the positioning snap piece 6, an external force is required to separate them to enable the positioning snap piece 6 to slide in the rack slot 91. While in the inclining direction of the teeth, i.e. the direction of the arrow, the toothed rack 92 can drive the positioning snap piece 6 to overcome the elastic force and automatically disengage from the teeth on the toothed rack 92 without any external force, and thus achieving quick one-way sliding.

Specifically, the meaning of one-way ratchet teeth is that the teeth of the toothed rack 92 extend obliquely upward from the edge of the slot, inclining toward the arrow direction beside the rack slot as shown in FIG. 1. When the jaw opening needs to be enlarged, i.e. the first handle 5 is pulled down from the top of the rack slot 91 (i.e. moving toward the opposite direction of the arrow), a trigger part 71 of the link mechanism is needed to disengage the positioning snap piece 6 from the toothed rack 92, and when the first handle 5 is pulled up from the lower part of the rack slot 91 (i.e. moving toward the direction of the arrow), because of the one-way ratchet teeth, even if the positioning snap piece 6 and toothed rack 92 are in engagement, the positioning snap piece 6 can still move along the rack slot freely. Thus, in the enlarged status of the jaw opening, put the object into the opening, and then shrink the opening just to match the size of the object to grip it.

The adjustable pliers can be water pump pliers, pipe pliers or other pliers, wherein the planes at the inner side of the first gripping part and the second gripping part are intersected at an angle, and a gap is formed between the first gripping part and the second gripping part. The shape of such jaw span is brought into better fitness with that of a hexagon nut. Compared to ordinary water pump pliers (which do not fit well with the hexagon nut in larger size), the present product can preferably fit with the hexagon nuts in all sizes within a gear range. The first gripping part 2 and the second gripping part 1 can be integrated with the first handle 5 and the second handle 9 respectively, or can be connected to the handles via connecting means as well.

The position of the first handle 5 and that of the link mechanism are relatively fixed. The link mechanism comprises a trigger shaft 7 connected with the positioning snap piece 6, and the trigger shaft 7 has a trigger part 71 thereon. The trigger part 71 is a pressing part of the trigger shaft 7 extending to the outer side of the surface of the first handle 5, which is convenient to trigger the trigger shaft 7 to move through the trigger part 71 when hand-holding the pliers body, thus adjusting the jaw opening at any time. The trigger part 71 drives the trigger shaft 7 to move, and the trigger shaft 7 drives the positioning snap piece 6 to rotate, thus disengaging from the toothed rack 92 on the rack slot 91 and enabling the first handle 5 to move relatively to the second handle 9 in a direction opposite to the arrow, which makes the jaw opening become larger.

The first handle 5 is provided with a first through-hole in the region of the trigger shaft 7, and the trigger shaft 7 passes through the first through-hole and then passes through the rack slot 91 of the second handle 9 to relatively fix the first handle 5 and the second handle 9. Further, the first handle 5 is provided with a lateral hole 51 on its lateral wall in the region of the connecting mechanism, which allows the corresponding region of the second handle 9 to pass through, forming a first part 52 of the first handle 5 located over the second handle 9 and a second part 53 of the first handle located beneath the second handle, wherein the trigger shaft 7 passes through the first part of the first handle 5, then through the rack slot 91 of the second handle, and further through the second part of the first handle 5. The positioning snap piece 6 is located inside the rack slot 91 of the second handle 9, engaging with the toothed rack 92.

Specifically, in the present embodiment, the trigger shaft 7 is arranged in the through-hole of the positioning snap piece 6. A first end of the trigger shaft 7 extends to the first part at one side of the first handle 5, and a second end extends to the second part at the other side of the first handle 5, being connected or integrated with the trigger part 71 which has the fixing function as well at the outer side of the first part, and being fixed with the trigger shaft 7 via a fixing element 10 at the outer side of the second part. The fixing element may be a cap body which fixes the trigger shaft 7 at the second part at the other side of the first handle 5, or may be a nut that is rotated onto rotating threads at the other end of the trigger shaft 7, thus fixing the trigger shaft 7. The trigger shaft 7 and the trigger part 71 as well as the cap body can move along with the first handle along the rack slot 91 of the second handle 9.

The link mechanism further comprises a roller pin 72 which is arranged on the trigger shaft 7 at the position of the positioning snap piece 6. One end of the roller pin 72 extends out from the lateral of the trigger shaft 7, and the other end of the roller pin 72 extends onto an inclined plane 64 of the positioning snap piece 6. The roller pin 72 can be fixedly connected or integrated with the trigger shaft 7. In the present embodiment, one end of the roller pin 72 extends into the lateral hole 76 of the trigger shaft 7, and is fixedly connected with the trigger shaft 7. The other end of the roller pin 72 extends to the inclined plane 64 on the positioning snap piece 6. The inclined plane 64 is located at the upper side of the through-hole of the positioning snap piece 6, and the lateral teeth 61 of the positioning snap piece 6 are located at the lower side of the through-hole of the positioning snap piece 6. The inclined plane 64 gradually descends from one side of the lateral teeth 61 of the positioning snap piece 6 to the other side thereof. In this way, when pressure is exerted to the trigger part 71, the trigger shaft 7 moves downwards, and the roller pin 72 moves downwards along with the trigger shaft 7, which forces the positioning snap piece 6 to rotate toward the higher side of the inclined plane 64 at the upper side part of the through-hole, thus enabling the lower part of the inclined plane 64 on the positioning snap piece 6 to accommodate the roller pin 72. Meanwhile, the positioning snap piece 6 moves in an opposite direction taking the trigger shaft 7 as axis at the lower side part of the through-hole, i.e., the lateral teeth 61 on the positioning snap piece 6 are separated from the toothed rack 92 on the rack slot 91, thus the first handle 5 can move in a direction opposite to the arrow along the second handle.

Further, the shape of the cross-section of the trigger shaft 7 is noncircular, specifically a notched circle in the present embodiment. The link mechanism of the present invention further comprises a sheet body 74 with a hollow hole 75, which makes it sheathed on the trigger shaft 7. The shape of the hollow hole fits that of the cross-section of the trigger shaft 7. In this way, when the trigger shaft 7 receives a pressing force, the sheet body 74 can limit the rotation of the trigger shaft 7, thus forcing the positioning snap piece 6 to rotate around the trigger shaft 7. The lateral hole of the trigger shaft 7 is located at the circular slot of the cross-section, and one end of the roller pin 72 is also arranged in a hole at the lateral slot of the trigger shaft 7. Specifically, the sheet body 74 is arranged at the rear of the positioning snap piece 6, located between the positioning snap piece 6 and the fixing element, i.e., the cap body, and is arranged inside the rack slot 91 together with the positioning snap piece 6. An outer edge of the sheet body 74 is square, fitting with an inner edge of the rack slot 91, without causing rotation around the trigger shaft 7, thus limiting the rotation of the trigger shaft 7, and fixing the trigger shaft 7 in the direction of rotation.

As described above, the lateral teeth 61 of the positioning snap piece 6 are located at one side of the lower part under the through-hole of the positioning snap piece 6, the positioning snap piece 6 is provided with a fixing part 62 and an elastic piece 63 at the other side, opposite to the lateral teeth 61, of the lower part under the through-hole of the positioning snap piece 6, and the elastic piece 63 is connected onto the fixing part 62 and propped against the second handle 9. Specifically, the fixing part 62 may be a spring hole, the elastic piece 63 is specifically a spring which is arranged in the spring hole and propped against the second handle 9. In this way, when the trigger part 71 is released, due to the action of the spring, the lateral teeth 61 of the positioning snap piece 6 can restore the engagement with the teeth on the toothed rack 92, thus being available for use.

Figure 6:
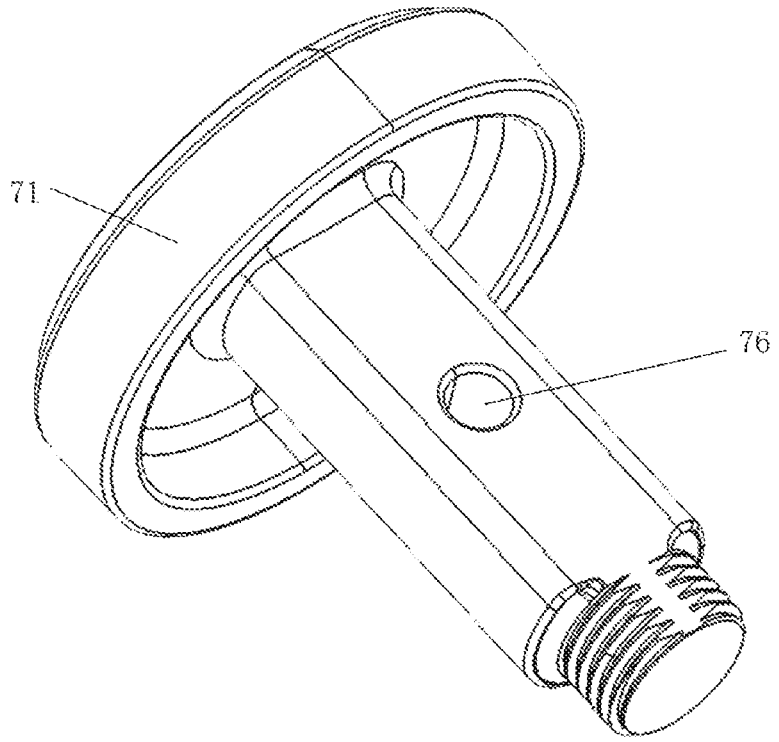
FIG. 6 is a perspective view of the trigger shaft according to a preferable embodiment of the present invention.

The link mechanism further comprises an elastic element, specifically a taper spring 73 arranged in the depression at the outer side of the first part of the first handle 5, and contacting the inner side of the trigger part 71. In this way, when no pressure is exerted to the trigger part 71, the taper spring can jack up the trigger part 71, and drive the link mechanism to restore to the home position, and to the initial state. As shown in FIG. 6, a peripheral surface of the trigger part 71 in the present preferable embodiment is circular. In other embodiments, the peripheral surface of the trigger part 71 can also be a shape suitable for installation such as a polygon.

Figure 7:
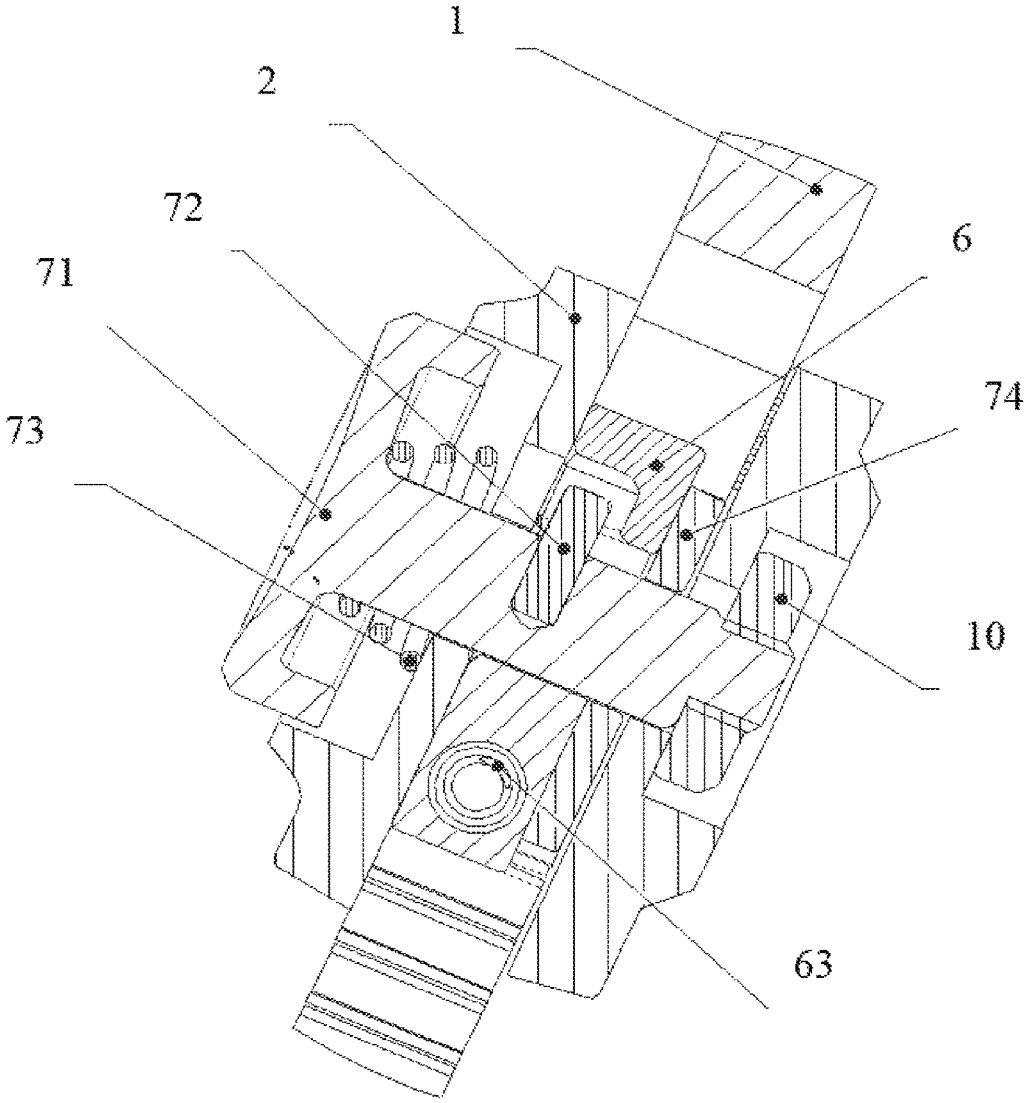
FIG. 7 is a sectional view according to a preferable embodiment of the present invention, wherein the trigger shaft is in an initial state.
Figure 8:
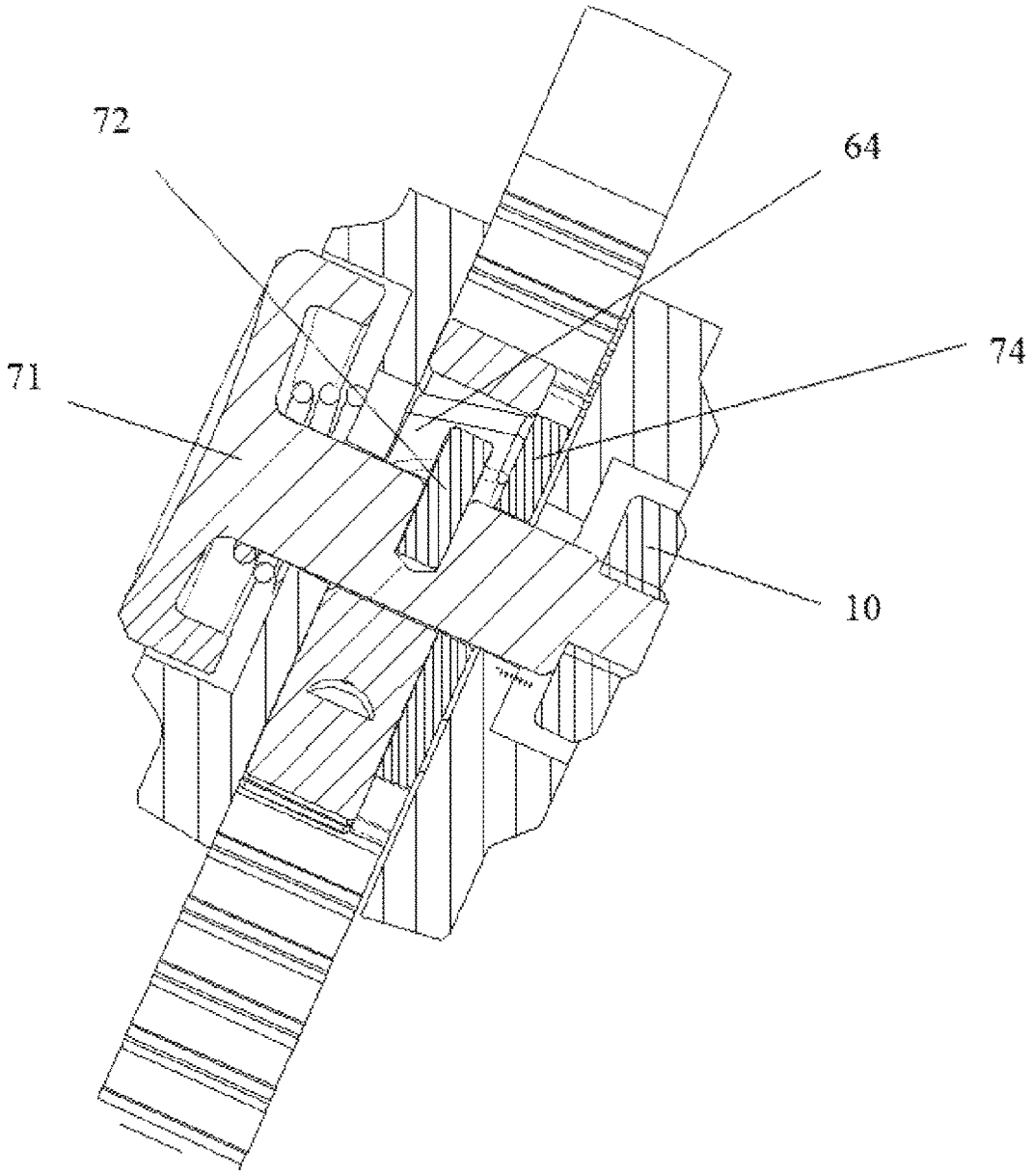
FIG. 8 is a sectional view according to a preferable embodiment of the present invention, wherein the trigger shaft is in a pressed state.

The structural function of the preferable embodiment of the present invention is achieved as follow. As shown in FIG. 8, pressure is applied on the trigger shaft 7, which drives the roller pin 72 to move in a direction of the applied force. When the roller pin 72 contacts the inclined plane 64 of the positioning snap piece 6, the positioning snap piece 6 rotates around the axis of the trigger shaft 7 under the action of the force, and the positioning snap piece 6 and the lateral teeth 61 are in a non-engaging state, thus achieving quick gear shifting, wherein a bottom guide sheet 74 limits the rotation of the trigger shaft 7, thus counteracting the counterforce of the inclined plane 64 against the roller pin 72. The pressure at the trigger shaft 7 is removed, and under the action of the elastic piece 63 and the taper spring 73, the whole structure resets to the initial state as shown in FIG. 7.

Figure 9:
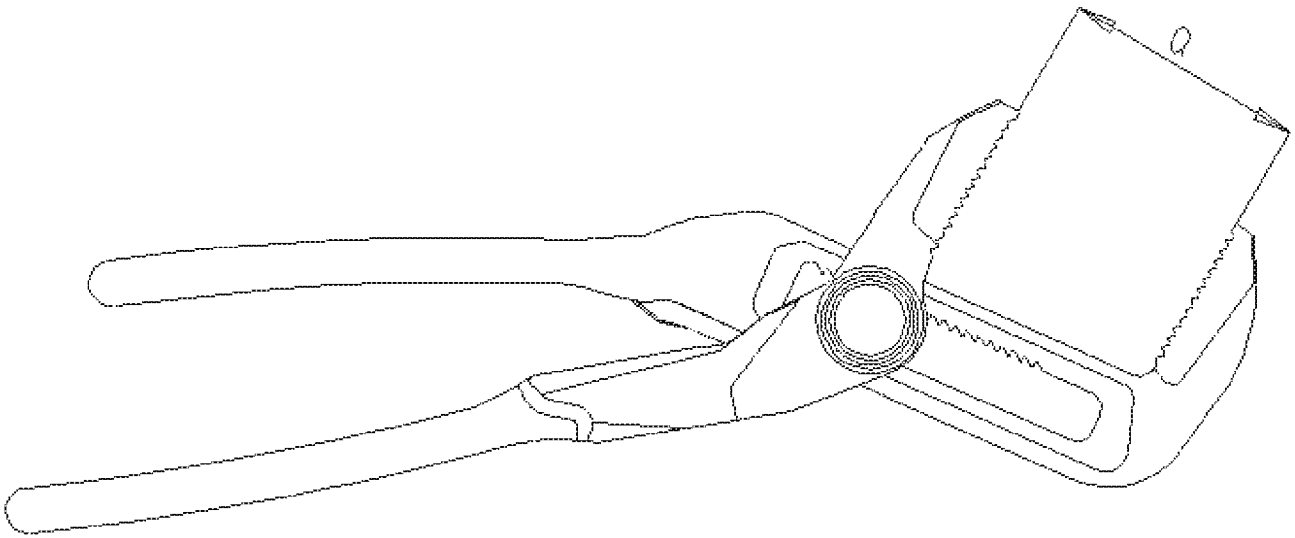
FIG. 9 is a schematic diagram of the jaw opening according to a preferable embodiment of the present invention.
Figure 10:
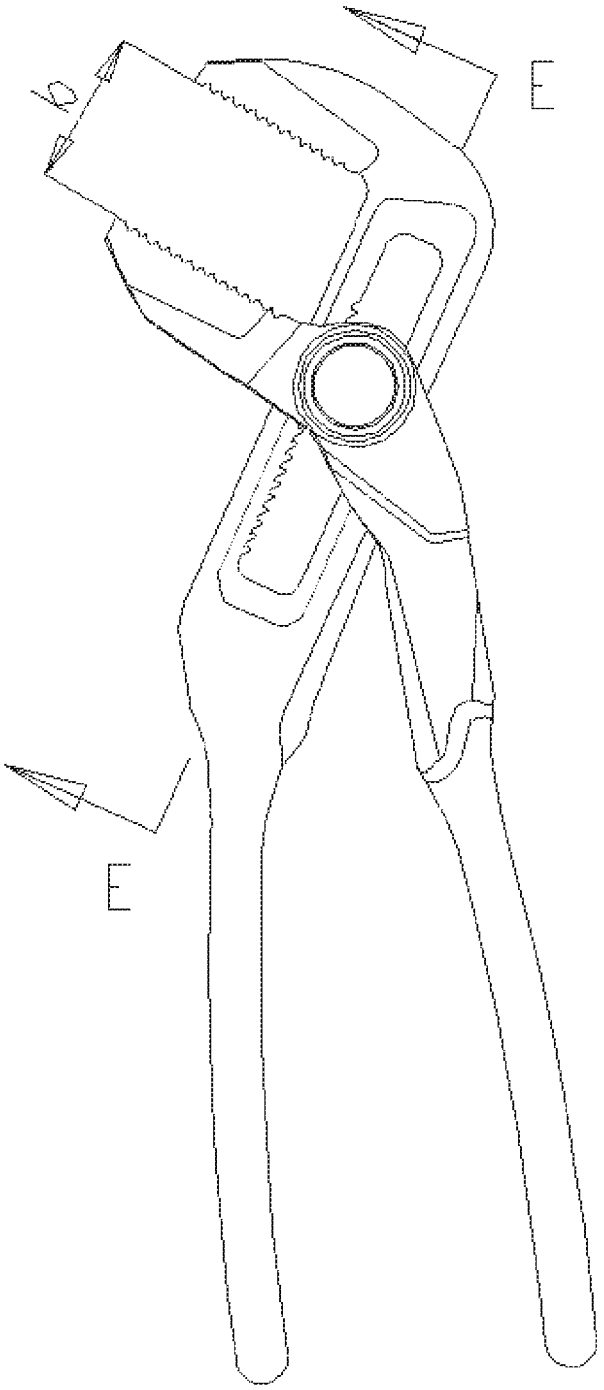
FIG. 10 is a schematic diagram of the jaw gripping objects according to a preferable embodiment of the present invention.

In the present embodiment, the right handle can be directly pushed to achieve the quick one-way adjustment from FIG. 9 to FIG. 10 (a parallel jaw span a needs to be greater than a parallel jaw span b), which is convenient and saves effort compared to the ordinary water pump pliers that need two-handed adjustment. The button can be integrated with the roller pin, which can save the processing cost and improve the production efficiency.

Figure 11:
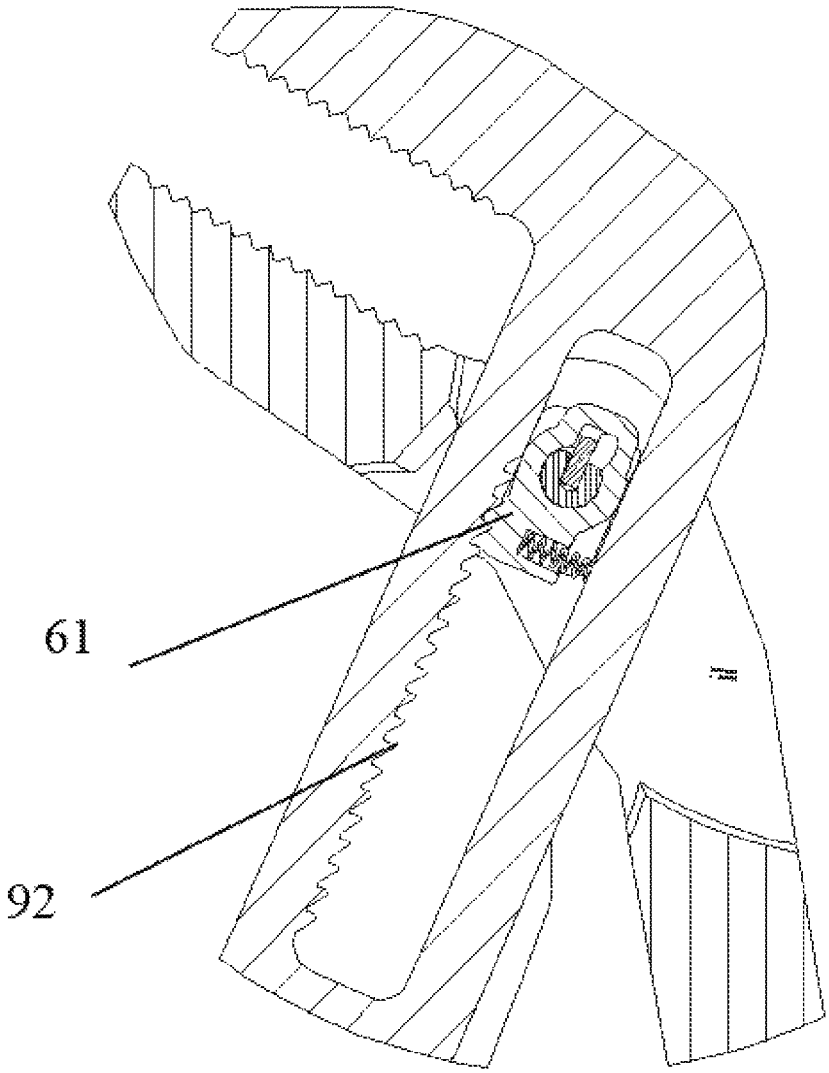
FIG. 11 is a side view according to a preferable embodiment of the present invention, wherein the lateral teeth of the positioning snap piece are in an engaging state.
Figure 12:
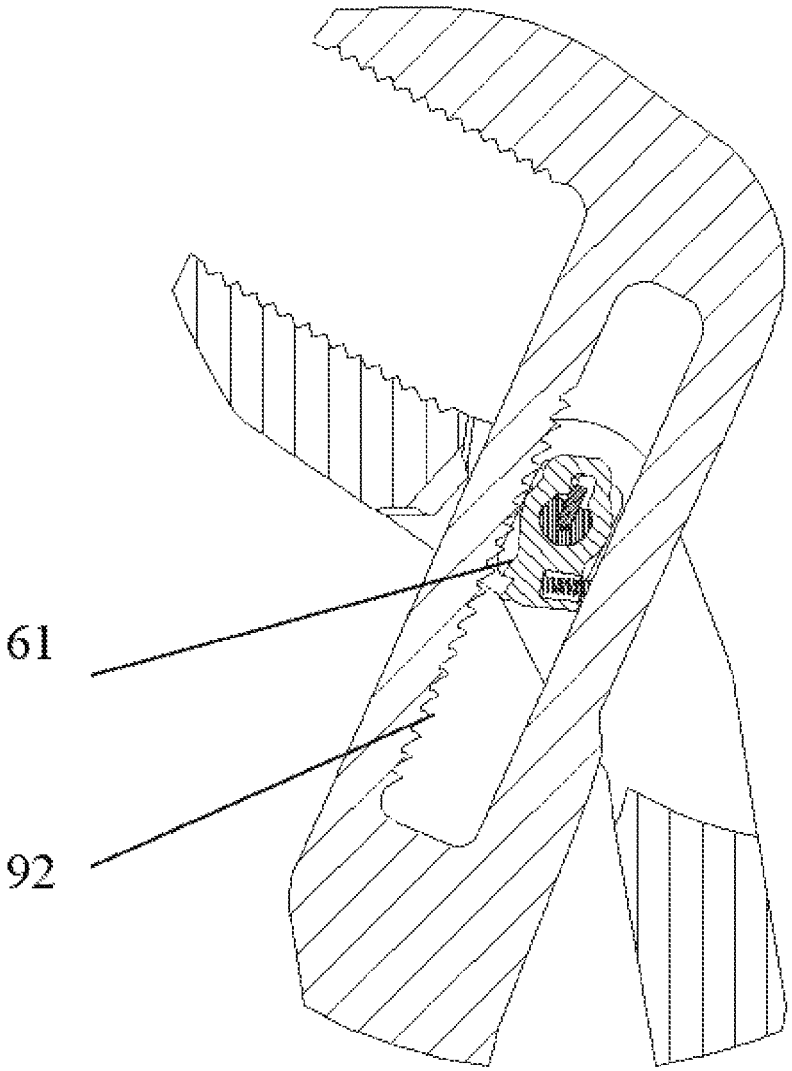
FIG. 12 is a side view according to a preferable embodiment of the present invention, wherein the lateral teeth of the positioning snap piece are in a disengaging state.

As shown in FIGS. 11-12, the jaws of the present embodiment can be adjusted as parallel planes, i.e., the inner sides of the first gripping part and the second gripping part are configured as planes, and the edges of the inner sides are provided with stripes. The planes at the inner sides of the first gripping part and the second gripping part are parallel. The shape of the jaw span is also brought into fitness with that of a hexagon nut. Compared to ordinary water pump pliers (which do not fit well with the hexagon nut in larger size), the present product can preferably fit with the hexagon nuts in all sizes within a gear range. The adjustable pliers of the present invention can achieve quick one-way gear adjustment, which is convenient and saves effort compared to the ordinary water pump pliers that need two-handed adjustment. By adoption of the present structure, the engagement between the teeth of the product is more stable, which is more convenient in operation.

Figure 13:
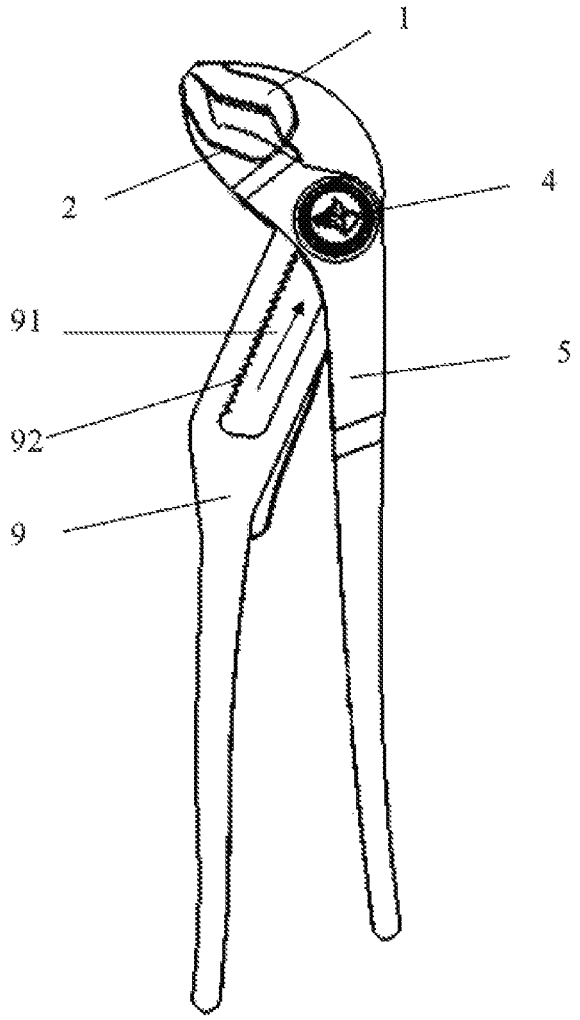
FIG. 13 is a schematic diagram according to a second embodiment of the present invention.
Figure 14:
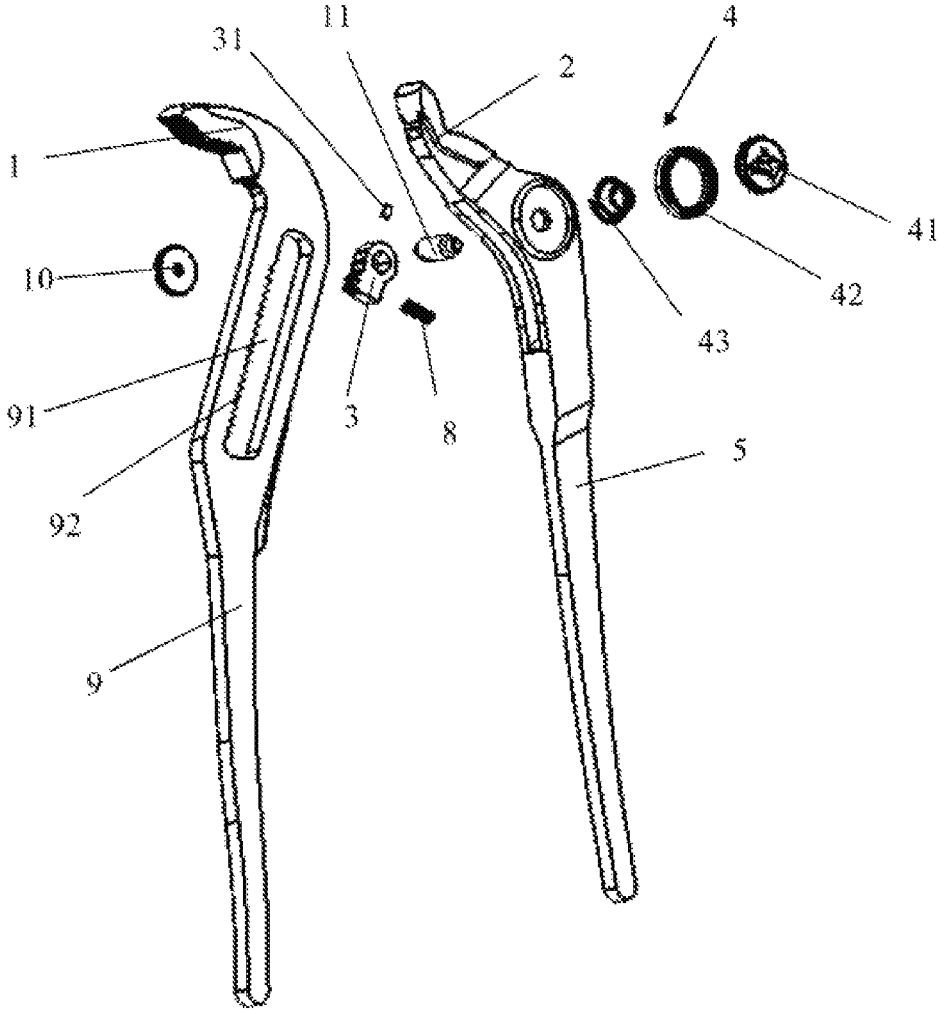
FIG. 14 is an exploded view according to a second embodiment of the present invention.
Figure 15:
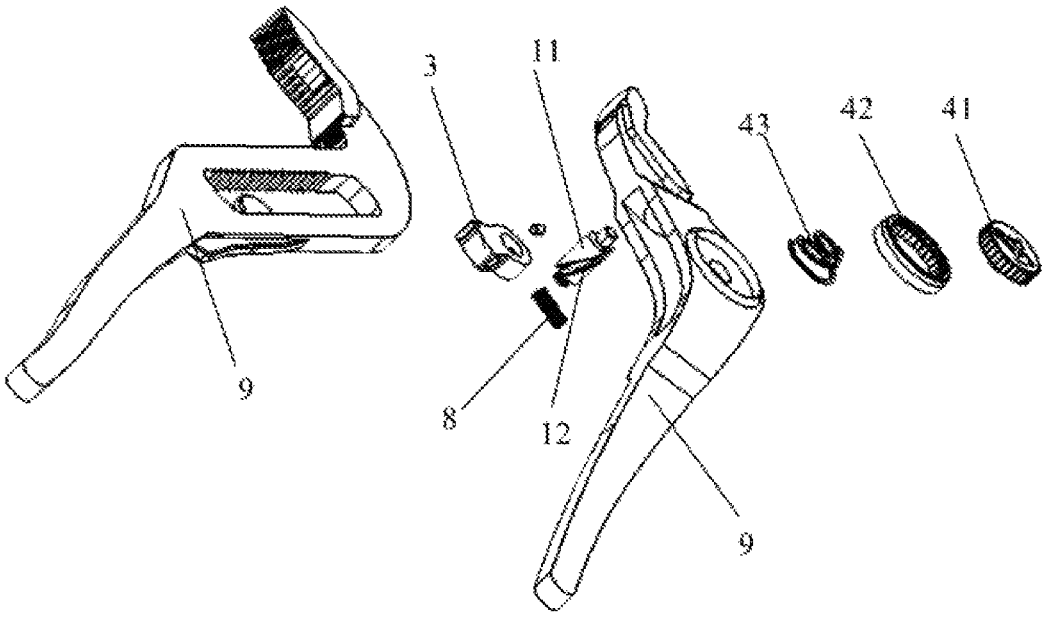
FIG. 15 is an exploded view according to a second embodiment of the present invention from another angle.
Figure 16:
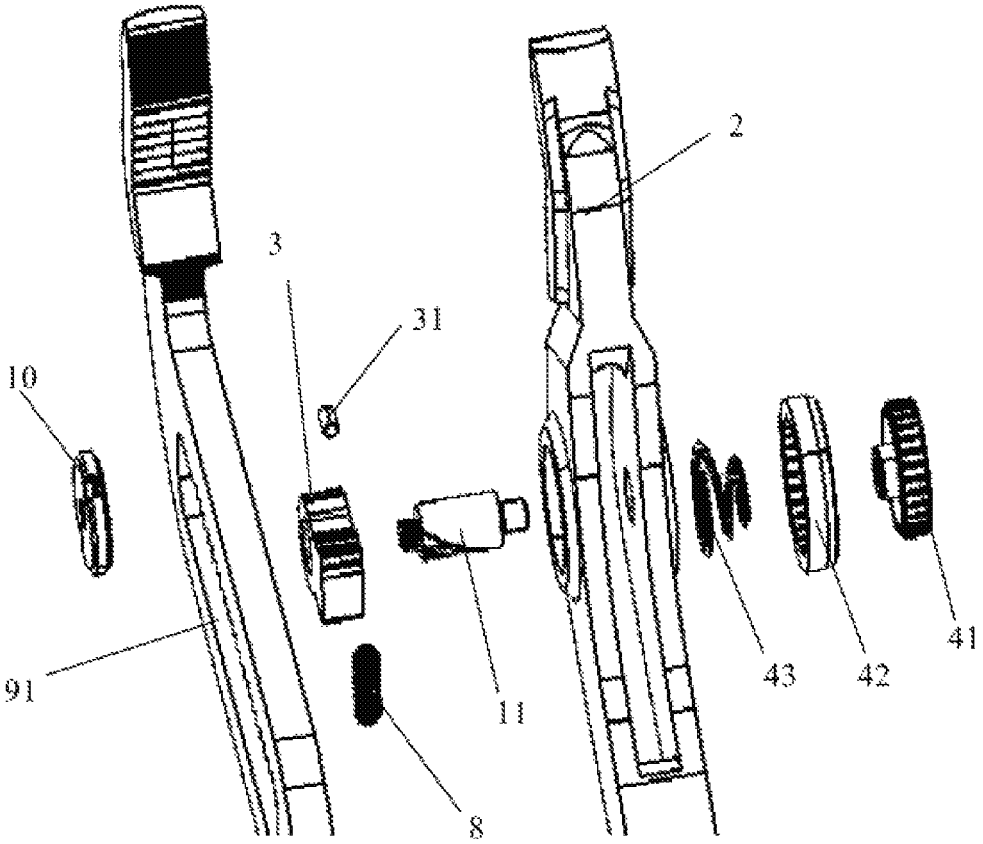
FIG. 16 is a local enlarged exploded view according to a second embodiment of the present invention.

As shown in FIGS. 13-16, the present invention provides a second embodiment. A pair of adjustable pliers comprises a first handle 5 having a first gripping part 2 arranged at the front end thereof and a second handle 9 having a second gripping part 1 arranged at the front end thereof. The first gripping part 2 and the second gripping part 1 form a jaw span, and the first handle and the second handle are arranged in an intersecting manner and relatively fixed via a connecting mechanism, wherein the second handle is provided with an elongated rack slot 91 in the region of the connecting mechanism and the rack slot 91 is provided with a toothed rack 92 on its inside flank. The connecting mechanism comprises a toothed block 3, which is arranged inside the rack slot 91 and engaged with the toothed rack 92 on the rack slot 91, and a link mechanism connected with the toothed block 3 to drive it to rotate and disengage from the rack slot 91. Thus the first handle 5 is able to move relative to the second handle 9 along the rack slot 91 through the movement of the connecting mechanisms to change the size of the opening, wherein the teeth on the toothed rack are one-way ratchet teeth, i.e. the teeth are all oblique toward one direction, inclining toward the direction of the arrow inside the rack slot as shown in FIG. 13. In this way, when a force is exerted in a direction opposite to the inclining teeth, i.e. the opposite direction of the arrow, due to the barbs between the toothed rack and the toothed block, an external force is required to separate them to enable the toothed block to slide in the rack slot. While in the inclining direction of the teeth, i.e. the direction of the arrow, the toothed rack can drive the toothed block to overcome the elastic force and automatically disengage from the teeth of the toothed rack without any external force, and thus realizing quick one-way sliding.

Specifically, the meaning of one-way ratchet teeth is that the teeth of the toothed rack extend obliquely upward from the edge of the slot, inclining toward the arrow direction inside the rack slot as in FIG. 13. When the opening needs to be enlarged, i.e. the first handle is pulled down from the top of the rack slot (i.e. moving toward the opposite direction of the arrow), a trigger member is needed to disengage the toothed block from the toothed rack, and when the first handle is pulled up from the lower part of the rack slot (i.e. moving toward the direction of the arrow), because of the one-way ratchet teeth, even if the toothed block and toothed rack are in engagement, the toothed block can still move along the rack slot freely. Thus, in the enlarged status of the jaw opening, put the object into the opening, and then shrink the opening just to match the size of the object to grip it.

The adjustable pliers can be water pump pliers, pipe pliers or other pliers, wherein both of the gripping parts are hook-like, and teeth are arranged on the edges of the inside flank thereof to facilitate gripping and engaging. The gripping parts can be integrated with the handles, or can be connected to the handles via connecting means as well.

The position of the first handle 5 and that of the link mechanism is relatively fixed. The link mechanism comprises a pivot 11 which is arranged in the through-hole of the toothed block 3, and a trigger mechanism which is connected with the pivot. The trigger mechanism drives the pivot to rotate, and the pivot further drives the toothed block to rotate, thus disengaging the toothed block from the toothed rack and making the relative movement become possible.

The first handle 5 is provided with a first through-hole in the region of the pivot, the pivot being cylindrical and its cross-section being circular; and the pivot passes through the first through-hole and then passes through the rack slot of the second handle 9 to relatively fix the first handle 5 and the second handle 9.

More specifically, the first handle is provided with a lateral hole on its lateral wall in the region of the connecting mechanism, which allows the corresponding region of the second handle to pass through, forming a first part of the first handle located over the second handle and a second part of the first handle located under the second handle; wherein the pivot passes through the first part of the first handle, and then through the rack slot of the second handle, and further through the second part of the first handle. The toothed block is located inside the rack slot of the second handle engaging with the rack slot.

One flank of the toothed block is provided with teeth which can engage with the toothed rack, and the other flank correspondingly is provided with a fixing part and an elastic piece, wherein the elastic piece is connected to the fixing part and propped against the second handle. Specifically, the fixing part can be a spring hole, and the elastic piece is concretely a spring 8, and the spring is arranged inside the spring hole propped against the second handle. Accordingly, after releasing the trigger member, the teeth of the toothed block can recover to the status of engagement with the teeth on the toothed rack due to the effect of the spring, thus the pliers can be normally used.

In the second embodiment, as shown in FIGS. 13-16, the outside of the pivot 11 is provided with a spiral second groove 12 with a guiding pin 31 on it, and the other end of the guiding pin extends into the toothed block through the lateral part. The trigger mechanism 4 further comprises a trigger switch 41, after the trigger switch produces a downward force, the guiding pin 31 starts to rotate along the spiral second groove 12, thereby drives the toothed block 3 to rotate and disengage from the rack slot, thus the first handle can move along the rack slot relative to the second handle.

The trigger mechanism further comprises a toothed ring 42 and a spring 43; the toothed ring 42 is provided with internal teeth and is fixedly arranged inside the depression of the outer side of the first part of the first handle; the spring is arranged inside the toothed ring beneath the trigger switch and inside the depression of outer side of the first part of the first handle. The trigger switch is provided with external teeth which can engage with the internal teeth of the toothed ring. Normally, the trigger switch and the toothed ring are separated; with the effect of the spring the trigger switch is jacked up by the spring and the external teeth of the trigger switch are separated from the internal teeth of the toothed ring. After the trigger switch is pressed, the external teeth of the trigger switch go inside the internal teeth of the toothed ring; because the toothed ring is fixed, after the internal teeth of the toothed ring engage with the external teeth of the trigger switch, the trigger switch stops rotating and the guiding pin 31 starts to rotate along the spiral second groove 12, thus driving the toothed block 3 to rotate. The inner diameter of the spring decreases gradually from the bottom to the direction of the trigger switch, the bottom is arranged inside the toothed ring 42 with internal teeth, which is inside the depression of the outer side of the first part of the first handle, and the top is in contact with the bottom of the trigger member.

The pivot is provided with a smaller head on the trigger member which is outside the first part of the first handle over the second handle, thus the pivot can be fixed inside the trigger member outside the first handle. While the other end of the pivot, i.e. the outer side of the second part of the first handle, is fixed via a fixing member 10. The other end of the pivot can be a thread and the fixing member 10 can be a nut, and accordingly, the pivot can be fixed by rotating the thread into the nut.

The invention has been exemplified above with reference to specific embodiments. However, it should be understood that a multitude of modifications and variations can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A pair of adjustable pliers, comprising a first handle having a first gripping part arranged at a front end thereof and a second handle having a second gripping part arranged at a front end thereof, the first gripping part and the second gripping part forming a jaw span, the first handle and the second handle being arranged in an intersectional manner and relatively fixed via a connecting mechanism, wherein the second handle has an elongated rack slot at a position of the connecting mechanism, and the rack slot is provided with a toothed rack on an inner side part thereof; the connecting mechanism comprises a positioning snap piece arranged inside the rack slot and a link mechanism connected with the positioning snap piece, the positioning snap piece has lateral teeth which are engaged with the toothed rack on the rack slot, and the link mechanism is provided to drive the positioning snap piece to rotate and disengage the lateral teeth on the positioning snap piece from the toothed rack; thus the first handle can move relative to the second handle along the rack slot through the movement of the connecting mechanism; the link mechanism comprises a trigger shaft connected with the positioning snap piece, and the trigger shaft has a trigger part thereon; wherein teeth of the toothed rack are one-way ratchet teeth; the trigger shaft is arranged in a through-hole of the positioning snap piece, and the trigger part is a pressing part of the trigger shaft extending to the outer side of the surface of the first handle; the link mechanism further comprises a roller pin arranged on the trigger shaft at a position of the positioning snap piece, one end of the roller pin extending out from the lateral of the trigger shaft, and the other end thereof extending onto an inclined plane of the positioning snap piece.

2. A pair of adjustable pliers according to claim 1, wherein the inclined plane is located at an upper side of the through-hole of the positioning snap piece, and the lateral teeth of the positioning snap piece are located at one side of the lower part under the through-hole of the positioning snap piece.

3. A pair of adjustable pliers according to claim 2, wherein the inclined plane gradually descends from one side of the lateral teeth of the positioning snap piece to the other side thereof.

4. A pair of adjustable pliers according to claim 2, wherein the positioning snap piece is provided with a fixing part and an elastic piece at the other side, opposite to the lateral teeth, of the lower part under the through-hole, and the elastic piece is connected onto the fixing part and propped against the second handle.

5. A pair of adjustable pliers according to claim 4, wherein the fixing part is a spring hole, and the elastic piece is a spring which is arranged inside the spring hole.

6. A pair of adjustable pliers according to claim 1, wherein the roller pin can be fixedly connected or integrated with the trigger shaft.

7. A pair of adjustable pliers according to claim 1, wherein one end of the roller pin extends into a lateral hole of the trigger shaft, and is fixedly connected with the trigger shaft.

8. A pair of adjustable pliers according to claim 1, wherein a shape of a cross-section of the trigger shaft is a notched circle.

9. A pair of adjustable pliers according to claim 8, wherein the link mechanism further comprises a sheet body with a hollow hole, which makes it sheathed on the trigger shaft, and the shape of the hollow hole fits that of the cross-section of the trigger shaft.

10. A pair of adjustable pliers according to claim 9, wherein a lateral wall of the first handle is provided with a lateral hole at a position of the connecting mechanism, and the lateral hole allows a corresponding region of the second handle to pass through, forming a first part of the first handle located over the second handle and a second part of the first handle located beneath the second handle; wherein the trigger shaft passes through the first part of the first handle, then passes through the rack slot of the second handle, and further passes through the second part of the first handle.

11. A pair of adjustable pliers according to claim 10, wherein a first end of the trigger shaft extends to the first part at one side of the first handle, and a second end extends to the second part at the other side of the first handle, wherein the trigger part is located at the outer side of the first part, and is fixed with the trigger shaft via a fixing element at the outer side of the second part.

12. A pair of adjustable pliers according to claim 11, wherein the sheet body is provided between the positioning snap piece and the fixing element.

13. A pair of adjustable pliers according to claim 11, wherein the sheet body is located inside the rack slot, and an outer edge of the sheet body is square, fitting an inner edge of the rack slot.

14. A pair of adjustable pliers according to claim 11, wherein the link mechanism further comprises a pressure spring which is arranged inside a depression of the outer side of the first part of the first handle, contacting the trigger part.

15. A pair of adjustable pliers according to claim 1, wherein the planes at the inner side of the first gripping part and the second gripping part are intersected at an angle, a gap is formed between the first gripping part and the second gripping part, and the edges of the inner sides of the first gripping part and the second gripping part are provided with stripes to facilitate gripping and engaging.

16. A pair of adjustable pliers according to claim 1, wherein the first gripping part or the second gripping part can be integrated with the first handle or the second handle, or can be connected to the handles via connecting means as well.

17. A pair of adjustable pliers according to claim 1, wherein the first gripping part and the second gripping part are configured as planes, the edges of the inner sides are provided with stripes, and the planes at the inner sides of the first gripping part and the second gripping part are parallel.

* * * * *